United States Patent [19]

Weber

[11] 4,056,701

[45] Nov. 1, 1977

[54] LOW PROFILE LIGHTED PUSH BUTTON SWITCH

[75] Inventor: John E. Weber, Fort Wayne, Ind.

[73] Assignee: Bowmar Instrument Corporation, Fort Wayne, Ind.

[21] Appl. No.: 703,526

[22] Filed: July 8, 1976

[51] Int. Cl.[2] ..... H01H 3/12

[52] U.S. Cl. ..... 200/314; 200/159 B; 340/365 R

[58] Field of Search ..... 200/5 A, 5 D, 56 R, 200/314, 159 R, 159 A, 159 B; 240/2 S, 2 SP; 340/365 R, 378 A; 116/124 L

[56] References Cited

U.S. PATENT DOCUMENTS

| | | | |
|---|---|---|---|
| 3,133,170 | 5/1964 | Nanninga | 200/159 B |
| 3,917,917 | 11/1975 | Murata | 200/159 B |
| 3,934,104 | 1/1976 | Stout | 200/159 R |

FOREIGN PATENT DOCUMENTS

| | | | |
|---|---|---|---|
| 2,522,269 | 4/1974 | Germany | 200/159 B |

*Primary Examiner*—Gerald P. Tolin
*Attorney, Agent, or Firm*—Gust, Irish, Jeffers & Rickert

[57] ABSTRACT

A low profile, lighted, push button switch including a printed wiring board having conductors terminating in switch contacts thereon. A first insulative member abuts the wiring board covering the conductors thereon and has an opening therein which exposes the switch contacts. A resilient switch element is positioned in the opening in the first insulative member cooperating with the switch contacts and actuatable between open and closed positions in response to force applied thereto. A thin sheet of insulating material covers the first insulative member extending over the opening and the switch element therein. A second insulative member abuts the insulating sheet and has an opening therein aligned with the opening in the first insulative member. A switch actuating member is positioned in the opening in the second insulative member. Another printed wiring board abuts the second insulative member and has at least one opening therein communicating with the opening in the second insulative member. A light source, such a light emitting diode, is carried on the other printed wiring board and is adapted to be energized by conductors thereon. A third insulative member abuts the other printed wiring board and has an opening therein aligned with the openings in first and second insulative members. A push button formed of light-transmissive material is positioned in the opening in the third insulative board and has a recess therein exposed to the light source. The push button has a projection thereon which extends through the opening in the other printed wiring board and which is adapted to engage the actuating member thereby to cause the same to engage the sheet of insulating material so as to apply force on the switch element to actuate the same in response to the pressure of the push button.

13 Claims, 5 Drawing Figures

LOW PROFILE LIGHTED PUSH BUTTON SWITCH

BACKGROUND OF THE INVENTION

1. Field of the Invention

This invention relates generally to lighted push button switches, and more particularly to a low profile, lighted push button switch assembly.

2. Description of the Prior Art

There is need for a low profile, i.e., thin, lighted push button switch, and there is a further need that the switch itself be sealed against the entrance of dust and other contaminates. It is further desirable that there be a light source associated with each push button of a group of push buttons, and that each light source be separately addressible, i.e., illuminated in response to actuation of the respective push button or some other push button, illuminated in response to the occurrence of some external event or condition, or illuminated at all times.

U.S. Pat. No. 3,766,350 discloses a low profile, lighted push button switch assembly wherein light emitting diodes are carried by the push button itself thus necessitating the use of flexible conductors for energizing the light emitting diodes. Other types of lighted push button switches have been proposed; however, to the best of the present applicant's knowledge and belief, such other lighted push button switches do not have a low profile configuration nor do they employ sealed contacts. Low profile lighted push button switch assemblies have been provided employing edge lighting of the push buttons; however, each push button does not have a separately addressable light source associated therewith.

SUMMARY OF THE INVENTION

In its broader aspects, the invention provides a low profile, lighted push button type switch assembly comprising a first insulative member having flat opposite surfaces with a recess formed in one surface. A switch including a resilient element is positioned in the recess, the element being actuatable between first and second positions in response to force exerted thereon. A relatively thin sheet of flexible insulating material engages the one surface of the first member covering the recess and switch element. A second insulative member is provided having flat opposite surfaces with one surface engaging the thin sheet, the sheet being sandwiched between the first and second insulative members. The second member has at least one opening therethrough communicating with the sheet and in alignment with a part of the recess in the first insulative member. Light source means are provided on the other surface of the second member for providing illumination in response to electrical energization. A push button member is provided having at least a first portion thereof formed of light-transmissive material, the first portion being disposed adjacent the other surface of the second member in light-receiving relation with the light source means. The push button member includes a second portion extending through the second member opening for movement therein, the second push button portion including means aligned with the recess in the first insulative member for engaging the sheet in response to depression of the push button member thereby to apply force on the switch element for actuating the same between said positions thereof.

It is accordingly an object of the invention to provide an improved, low profile, lighted push button switch.

Another object of the invention is to provide an improved, low profile, lighted switch wherein the switch element is sealed against contamination.

A further object of the invention is to provide an improved, lighted, push button switch wherein a light source is associated with the push button and is separately addressable without the use of flexible conductors.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
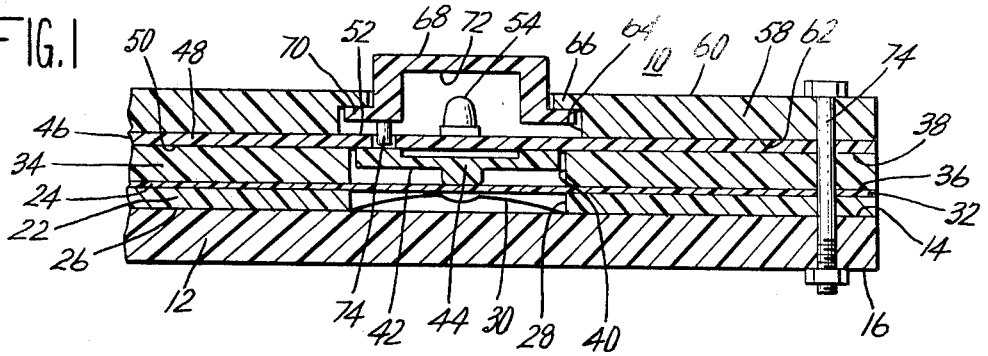
FIG. 1 is a side cross-sectional view illustrating the improved, lighted push button switch of the invention.
Figure 2:
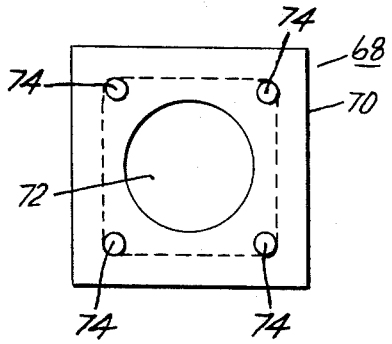
FIG. 2 is a bottom view of the push button of FIG. 1.
Figure 3:
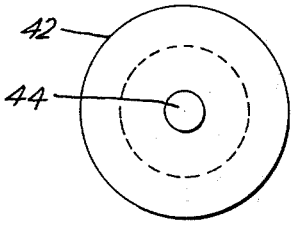
FIG. 3 is a bottom view of the switch actuating member of FIG. 1.

Referring now to FIGS. 1 through 4 of the drawings, the improved, low profile, lighted push button switch assembly of the invention, generally indicated at 10, comprises a printed wiring board 12 having opposite flat surfaces. Conductors 18 and switch contacts 20 are printed or otherwise deposited in conventional fashion on surface 14 of board 12.

An insulative member 22, having opposite flat surfaces 24, 26 is positioned with its surface 26 engaging surface 14 of board 12. Insulative member 22 has opening 28 formed therein which exposes switch contacts 20 on surface 14 of board 12. Resilient switch element 30, which may be of the type shown and described in U.S. Pat. No. 3,796,843, is positioned in opening 28 cooperating with switch contacts 20 and is actuable between first and second positions in response to the application of force thereon.

It will readily be understood that board 12 and insulative member 22 may be formed as single member with opening 28 formed as a recess therein and with the conductors connected to the switch contacts 20 extending through the resulting unitary member.

Thin sheet 32 of insulating material is adhered to surface 24 of insulative member 22 covering opening 28 and switch element 30 therein thereby sealing switch element 30 against dust and other contaminates.

Insulative member 34 has opposite flat surfaces 36, 38 with surface 36 engaging sheet 32. Member 34 has opening 40 therein in alignment with opening 28 in member 22. Switch actuating member 42 is positioned in opening 40 and has a center projection 44 engaging sheet 32.

A second printed wiring board 46 has opposite flat surfaces 48, 50 with surface 50 engaging surface 38 of insulative member 34. Board 46 extends across opening 40 in member 34 and has a plurality of openings 52 communicating therewith. Light source 54, such as a light emitting diode (LED) or incandescent lamp, is mounted on surface 48 of board 46 and is adapted to be energized by conductors 56 printed or otherwise deposited on surface 48 of board 46. It will readily be seen that insulative member 34 and board 46 may be formed as a single member with opening 40 formed as a recess therein.

Insulative member 58 has flat opposite surfaces 60, 62 with surface 62 engaging surface 48 of board 46 and covering conductors 56 thereon. Member 60 has opening 64 therein having peripheral lip 66, opening 64 being aligned with openings 28 and 40.

Push button 68 formed of light transmissive material is positioned in opening 64 in member 58 and has peripheral flange 70 which cooperates with lip 66 to retain push button 68 in opening 64. Push button 68 has recess 72 formed therein into which light source 54 extends. Push button 68 has a plurality of post elements 74 respectively extending through openings 52 in board 46 and engaging actuating member 42. It will now be readily seen that manual depression of push button 68 results in downward movement of actuating member 42 so that projection 44 thereon engages sheet 32 and causes it, in turn, to apply force on switch element 30 to actuate the same from one to its other position. It will readily understood that when the depressive force is removed from push button 68, switch element 30 will resiliently return to its normal position thus urging actuating member 42 and push button 68 to their normal positions, as shown in FIG. 1.

Board 12, insulative member 22, insulative sheet 32, insulative member 24, board 46, and insulative member 58 are clamped in assembled relation by suitable threaded fastener 74.

Figure 5:
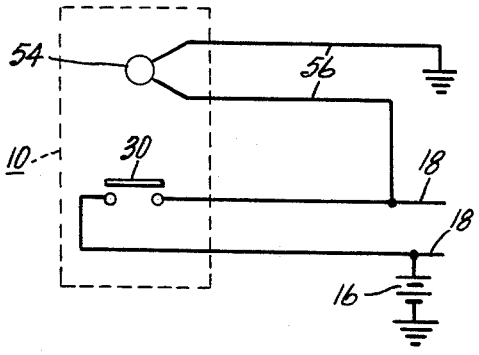
FIG. 5 is a schematic illustration of one connection of the light source and switch element shown in FIG. 1.
Figure 4:
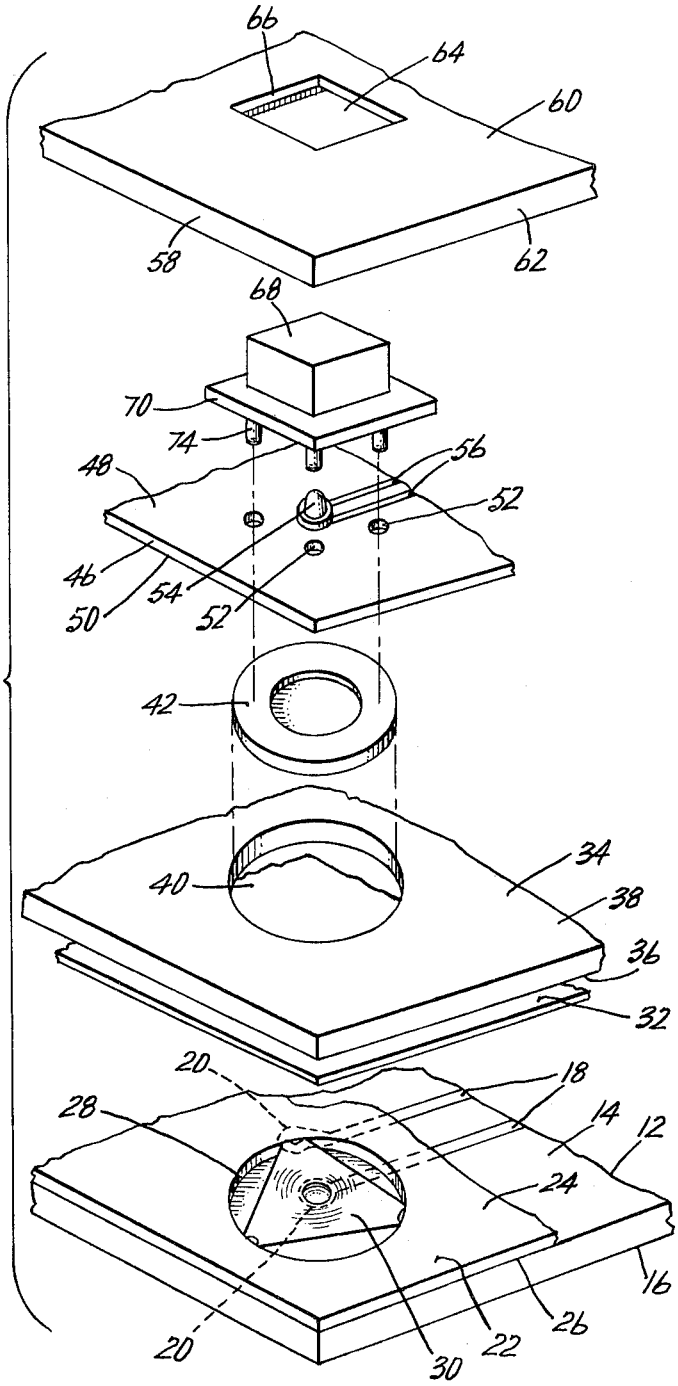
FIG. 4 is a fragmentary, exploded, perspective view illustrating the switch assembly of FIG. 1.

Referring now to FIG. 5, it will be seen that conductors 56 associated with a particular light source 54 may be connected to conductors 18 for switch 30 of the same switch assembly 10 so that light source 54 is illuminated by battery 76 in response to closing of switch 30. It will also readily be seen that each light source 54 associated with a particular push button 68 is separately addressable by its conductors 56 and thus may be illuminated in response to actuation of a switch element 30 associated with a different push button assembly, or may be illuminated by external circuitry, such as computer circuitry to indicate to the operator which push button is to be actuated next in a series of complex instructions. As another alternative, all of the light sources 54 of a group of push buttons comprising a keyboard may be illuminated simultaneously. It will further be readily seen that each push button 68 may have two or even more light sources associated therewith.

It will now be seen that the lighted push button assembly of the invention permits a very low profile which is useful in applications where volume is at a premium such as in aircraft cockpits and citizen band radios; in a physical embodiment of the invention, the entire thickness of switch assembly 10 is only 0.4 inches. It will further be seen that the assembly is simple and relatively inexpensive to fabricate, and that the lighted push buttons can be closely grouped together; in the aforesaid physical embodiment of the invention, the push buttons are spaced on 0.5 inch centers. It will be understood that legends may be provided on the push buttons in any of several conventional ways such as etching, printing, etc. It will be further seen that the LEDs or lamps illuminating the push buttons are rigidly mounted on board 46 without the use of flexible conductors thus providing longer life.

While there have been described above the principles of this invention in connection with specific apparatus, it is to be clearly understood that this description is made only by way of example and not as a limitation to the scope of the invention.

What is claimed is:

1. In a low profile, lighted push button-type switch assembly: first rigid insulative means for supporting a switch and having flat opposite surfaces with a first opening formed in one surface thereof; a switch including a resilient element in said first opening, said element being actuable between first and second positions in response to force exerted thereon; a relatively thin sheet of flexible insulating material engaging said one surface of said first means covering said first opening and switch element; second rigid insulative means for supporting push button means and having flat opposite surfaces with one surface engaging said sheet, said sheet being sandwiched between said first and second insulative means, said second insulative means having at least a second opening therethrough communicating with said sheet and in alignment with a part of said first opening; light source means on the other surface of said second insulative means for providing illumination in response to electrical energization; and push button means for actuating said switch including a first element formed of light-transmissive material, said first element being disposed adjacent said other surface of said second insulative means in light-receiving relation with said light source means, said push button means including a second element extending through said second opening for movement therein, said push button means also including a third element aligned with said first opening for engaging said sheet in response to depression of said push button means thereby to apply force on said switch element for actuating the same between said positions thereof.

2. The switch assembly of claim 1 wherein said first insulative means comprises first and second insulative elements each having flat opposite surfaces with respective first surfaces in engagement, said first opening being in said second element exposing an area of said first surface of said first element, and conductors terminating at switch contacts on said first surface of said first element with said contacts being in said area.

3. The switch assembly of claim 1 wherein said second insulative means comprises first and second insulative elements each having flat opposite surfaces with respective first surfaces in engagement, said first element having a third opening therein communicating with said sheet and in alignment with said first opening, said second opening being in said second element and communicating with said third opening, said third push button means element being disposed in said third opening.

4. The switch assembly of claim 3 wherein said second push button means element comprises a rod integrally joined to said first push button means element and having a distal end disposed in said second opening and adapted to engage said third push button means element.

5. The switch assembly of claim 4 wherein said first push button means element has a recess therein exposed to the other surface of said second element of said second insulative means, said light source means being on said last-named other surface and disposed in said last-named recess.

6. The switch assembly of claim 5 wherein said other surface of said second element of said second insulative means has conductors thereon connected to said light source means.

7. The switch assembly of claim 6 wherein said light source means comprises at least one light-emitting diode.

8. The switch assembly of claim 4 wherein there are a plurality of said second openings in said second element of second insulative means, there being a plurality of said rods surrounding said light source means and respectively extending through said second openings.

9. The switch assembly of claim 1 further comprising third insulative means for retaining said first push button means element and having flat opposite surfaces with one surface engaging the other surface of said second insulating means, said third insulative means having an opening therein receiving said first push button means element.

10. The switch assembly of claim 9 further comprising means for clamping said insulative means and sheet in assembled relation.

11. The switch assembly of claim 9 wherein said first push button means element has a peripheral flange thereon, said third insulative member having a lip surrounding said opening therein adjacent the other surface thereof, said lip cooperating with said flange to retain said first push button means element in said third insulative means opening.

12. The switch assembly of claim 1 wherein said first insulative means comprises first and second insulative elements each having flat opposite surfaces with respective first surfaces in engagement, said first opening being in said second element and exposing an area of said first surface of said first element, and conductors terminating at switch contacts on said first surface of said first element with said contacts being in said area; said second insulative means comprising first and second insulative elements each having flat opposite surfaces with respective first surfaces in engagement, said first element having a third opening therein communicating with said sheet and in alignment with said first opening, said second opening being in said second element and communicating with said third opening, said third push button means element being disposed in said third opening, said first push button means element having a recess therein exposed to the other surface of said second element of said second insulative means, said light source means being on said last-named other surface and disposed in said last-named recess, said other surface of said second element of said second insulative means having conductors thereon connected to said light source means, said second push button means element comprising a rod integral with said first push button means element and having a distal end disposed in said second opening and adapted to engage said third push buttons means element; and further comprising third insulative means for retaining said first push button means element and having flat opposite surfaces with one surface engaging the other surface of said second insulating means, said third insulative means having an opening therein receiving said first push button means element; and means for clamping said insulative means and sheet in assembled relation.

13. A low profile, lighted push button type switch comprising a first printed wiring board having conductors thereon terminating in switch contacts; a first insulative member abutting said first board covering said conductors and having an opening therein exposing said contacts; a resilient switch element positioned in said first member cpening cooperating with said contacts and actuable between open and closed positions in response to force applied thereto; a thin sheet of flexible insulating material covering and adhered to said first member and extending over said opening therein and said switch element; a second insulative member abutting said sheet and having an opening therein in alignment with said first member opening; an actuating member positioned in said second member opening; a second printed wiring board abutting said second insulative member and having an opening therein communicating with said second member opening; a third insulative member abutting said second board and having an opening therein aligned with said first and second member openings; a light source on said second board positioned in said third member opening and adapted to be energized by conductors on said second board; and a push button formed of light transmissive material positioned in said third member opening and having a recess therein exposed to said light source, said push button having a projection thereon extending through said second board opening and adapted to engage said actuating member thereby to cause the same to engage said sheet to actuate said switch element in response to depression of said push button.

* * * * *